US009272858B2

(12) United States Patent
Hirose

(10) Patent No.: US 9,272,858 B2
(45) Date of Patent: Mar. 1, 2016

(54) IMAGE FORMING APPARATUS

(71) Applicant: Atsuo Hirose, Nagoya (JP)

(72) Inventor: Atsuo Hirose, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/626,936

(22) Filed: Sep. 26, 2012

(65) Prior Publication Data

US 2013/0136517 A1 May 30, 2013

(30) Foreign Application Priority Data

Nov. 28, 2011 (JP) ..... 2011-259262

(51) Int. Cl.
*B65H 3/06* (2006.01)
*G03G 15/00* (2006.01)
*B41J 13/076* (2006.01)

(52) U.S. Cl.
CPC ..... *B65H 3/0669* (2013.01); *B41J 13/076* (2013.01); *B65H 3/0684* (2013.01); *G03G 15/6511* (2013.01); *B65H 2403/721* (2013.01); *B65H 2553/41* (2013.01); *B65H 2553/612* (2013.01); *B65H 2601/324* (2013.01); *G03G 2215/00679* (2013.01); *G03G 2215/00721* (2013.01)

(58) Field of Classification Search
CPC ..... B65H 1/04; B65H 3/0615; B65H 3/0684; B65H 2404/17; B65H 2404/174; B65H 2404/40; B65H 2404/41; B65H 3/0669; B65H 3/0638; B65H 3/06; B65H 3/0676; B65H 2402/31; B65H 2402/522
USPC ..... 271/121, 114, 117, 118, 245, 246, 122, 271/124, 125, 109
See application file for complete search history.

(56) References Cited

U.S. PATENT DOCUMENTS

| | | | | |
|---|---|---|---|---|
| 5,265,859 | A * | 11/1993 | Watson et al. | 271/109 |
| 6,307,621 | B1 * | 10/2001 | Endo et al. | 355/407 |
| 6,805,509 | B2 | 10/2004 | Ahn | |
| 6,918,583 | B2 | 7/2005 | Asada et al. | |
| 7,644,921 | B2 | 1/2010 | Hattori | |
| 7,717,415 | B2 * | 5/2010 | Kim et al. | 271/110 |

(Continued)

FOREIGN PATENT DOCUMENTS

| | | | |
|---|---|---|---|
| CN | 102114994 | A | 7/2011 |
| JP | 05-011527 | A | 1/1993 |

(Continued)

OTHER PUBLICATIONS

Dec. 3, 2014—(CN) Office Action—App. 201210362905.4—Eng Tran.

*Primary Examiner* — Thomas Morrison
(74) *Attorney, Agent, or Firm* — Banner & Witcoff, Ltd.

(57) ABSTRACT

An image forming apparatus includes an image forming unit, a roller, a driving shaft, a support shaft, a bearing portion, a contact member and a pivot shaft. The driving shaft is removably connected to one end of the roller and the support shaft is disposed at the other end of the roller in an axial direction. The pivot shaft is configured to pivotably support the contact member, and includes a rotating shaft disposed coaxially with an axis line of the roller and an eccentric portion extending toward the roller at a position on the other end side of the roller and eccentric from an axis line of the rotating shaft. The contact member is disposed in the eccentric portion. Distance from the axis line of the rotating shaft to the eccentric portion in a radial direction is larger than dimension of the support shaft in a radial direction.

8 Claims, 8 Drawing Sheets

(56) References Cited

U.S. PATENT DOCUMENTS

| | | | | |
|---|---|---|---|---|
| 2003/0215274 | A1 | 11/2003 | Ahn | |
| 2004/0012139 | A1 | 1/2004 | Asada et al. | |
| 2005/0035534 | A1 | 2/2005 | Kim et al. | |
| 2007/0018383 | A1 | 1/2007 | Ohara et al. | |
| 2008/0219732 | A1 | 9/2008 | Hattori | |
| 2009/0273137 | A1* | 11/2009 | Chen et al. | 271/121 |
| 2011/0127710 | A1* | 6/2011 | Yamomoto et al. | 271/10.11 |
| 2011/0157767 | A1 | 6/2011 | Hur et al. | |

FOREIGN PATENT DOCUMENTS

| | | | |
|---|---|---|---|
| JP | 2003-335434 | A | 11/2003 |
| JP | 2004-051285 | A | 2/2004 |
| JP | 2006-282311 | A | 10/2006 |
| JP | 2007-039242 | A | 2/2007 |
| JP | 2008-058388 | A | 3/2008 |
| JP | 2011-139021 | A | 7/2011 |

* cited by examiner

DIAGRAM ALONG ARROW A

IMAGE FORMING APPARATUS

CROSS REFERENCE TO RELATED APPLICATION

The present application claims priority from Japanese Patent Application No. 2011-259262, which was filed on Nov. 28, 2011, the disclosure of which is incorporated herein by reference in its entirety.

BACKGROUND

1. Field of the Invention

The present invention relates to an image forming apparatus for forming an image on a sheet.

2. Description of the Related Art

An image forming apparatus including rollers configured to convey sheets is known. In such an image forming apparatus, an outer peripheral surface of the roller is gradually worn out, and the worn roller may frequently cause failure in conveyance of the sheet.

SUMMARY

A need has arisen to provide an image forming apparatus capable of replacing the rollers easily.

An image forming apparatus includes an image forming unit, a roller, a driving shaft, a support shaft, a bearing portion, a contact member and a pivot shaft. The image forming unit is configured to form an image on a sheet. The roller is configured to rotate in contact with the sheet. The driving shaft is disposed coaxially with an axis line of the roller, and is configured to transmit rotating force to the roller and to be removably connected to one end of the roller in an axial direction. The support shaft is disposed at the other end of the roller in the axial direction, is configured to support the roller, and extends in the axial direction. The bearing portion is configured to support the support shaft movably in parallel with the axial direction. The contact member is disposed at the other end side of the roller in the axial direction, and is configured to pivot between a contact position at which the contact member is in contact with the sheet conveyed by the roller and a non-contact position at which the contact member is not in contact with the sheet. The pivot shaft is configured to pivotably support the contact member, and includes a rotating shaft and an eccentric portion. The rotating shaft is disposed coaxially with the axis line of the roller. The eccentric portion extends toward the roller at a position where is on the other end side of the roller in the axial direction and where is eccentric from an axis line of the rotating shaft. The contact member is disposed in the eccentric portion. Distance from the axis line of the rotating shaft to the eccentric portion in a radial direction is larger than dimension of the support shaft in a radial direction.

BRIEF DESCRIPTION OF THE DRAWINGS

FIGS. 5A and 5B are diagrams illustrating removal of the roller unit of the image forming apparatus according to the embodiment of the present invention, in which FIG. 5A is the diagram seen from the front and FIG. 5B is the diagram seen from below.

FIGS. 6A and 6B are diagrams illustrating an operation of a contact member of the image forming apparatus according to the embodiment of the present invention, in which FIG. 6A illustrates a non-contact position and FIG. 6B illustrates a contact position.

DESCRIPTION OF THE PREFERRED EMBODIMENTS

An embodiment of the present invention described below is an example of embodiments. That is, the matters defining the invention specified in the claims are not limited to concrete means, structures, and so forth which are described in the following embodiment.

In the present embodiment, the present invention is applied to an electrophotographic image forming apparatus. Hereinafter, the embodiment of the present invention will be described with reference to the drawings.

1. Schematic Structure of Image Forming Apparatus

Figure 1:
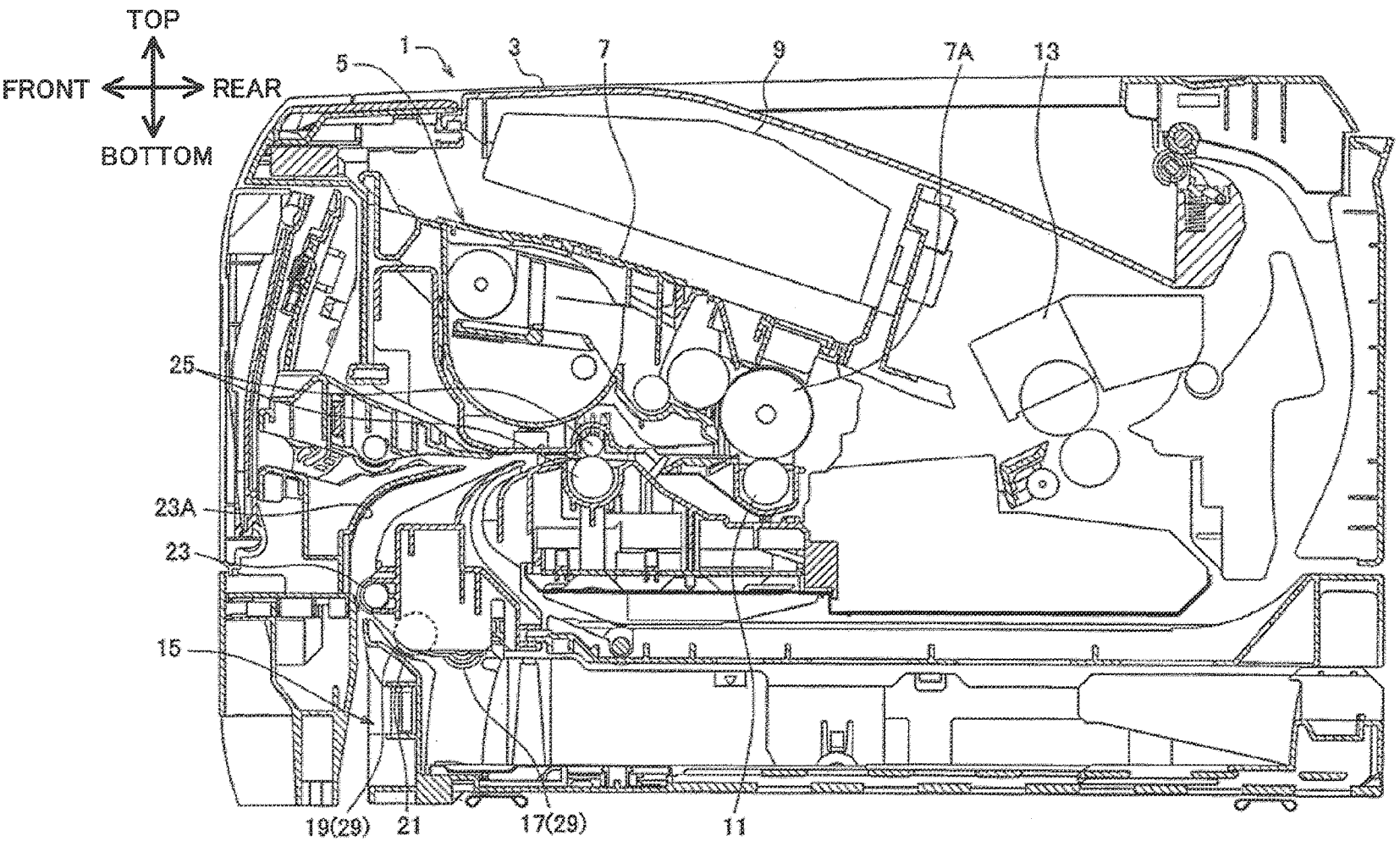
FIG. 1 is a central cross-sectional view of an image forming apparatus according to an embodiment of the present invention.

As illustrated in FIG. 1, an image forming apparatus 1 includes a monochrome image forming unit 5 in a housing 3. The image forming unit 5 forms an image on a sheet by transferring a developer image to a sheet, such as a recording sheet and an OHP sheet.

The image forming unit 5 according to the present embodiment includes a process cartridge 7, an exposure unit 9, a transfer roller 11, and a fixing unit 13. The process cartridge 7 forms a developing unit. The exposure unit 9 exposes a photoconductor drum 7A. The transfer roller 11 transfers a developer image formed on the photoconductor drum 7A to a sheet. The fixing unit 13 heats and fixes the developer image transferred to the sheet.

A paper cassette 15 is a paper feed tray in which a pile of sheets which are to be conveyed to the image forming unit 5 is contained. The paper cassette 15 according to the present embodiment may be attached to and removed from an apparatus main body (i.e., the housing 3).

The sheets contained in the paper cassette 15 are sent out toward the image forming unit 5 by a pickup roller 17, separated one by one by a separation roller 19 and a separating pad 21, and then conveyed to the image forming unit 5. In the present embodiment, the pickup roller 17 and the separation roller 19 are integrated with each other via a roller holder 29A, which will be described later, and constitute a roller unit 29.

The separating pad 21 is disposed to face the separation roller 19 and applies carrying resistance to the sheet. The separation roller 19 applies conveying force to the sheet by rotating in contact with the sheet. Therefore, even if plural sheets are sent out toward the image forming unit 5 from the pickup roller 17, these sheets are separated one by one and conveyed to the image forming unit 5.

The sheet sent out from the separation roller 19 is conveyed by the conveyance roller 23 while its conveying direction thereof is turned upward by a conveying chute 23A. Then, the attitude of the sheet is collected by a pair of resist rollers 25 and the sheet is sent to the image forming unit 5 at predetermined timing.

Figure 2A:
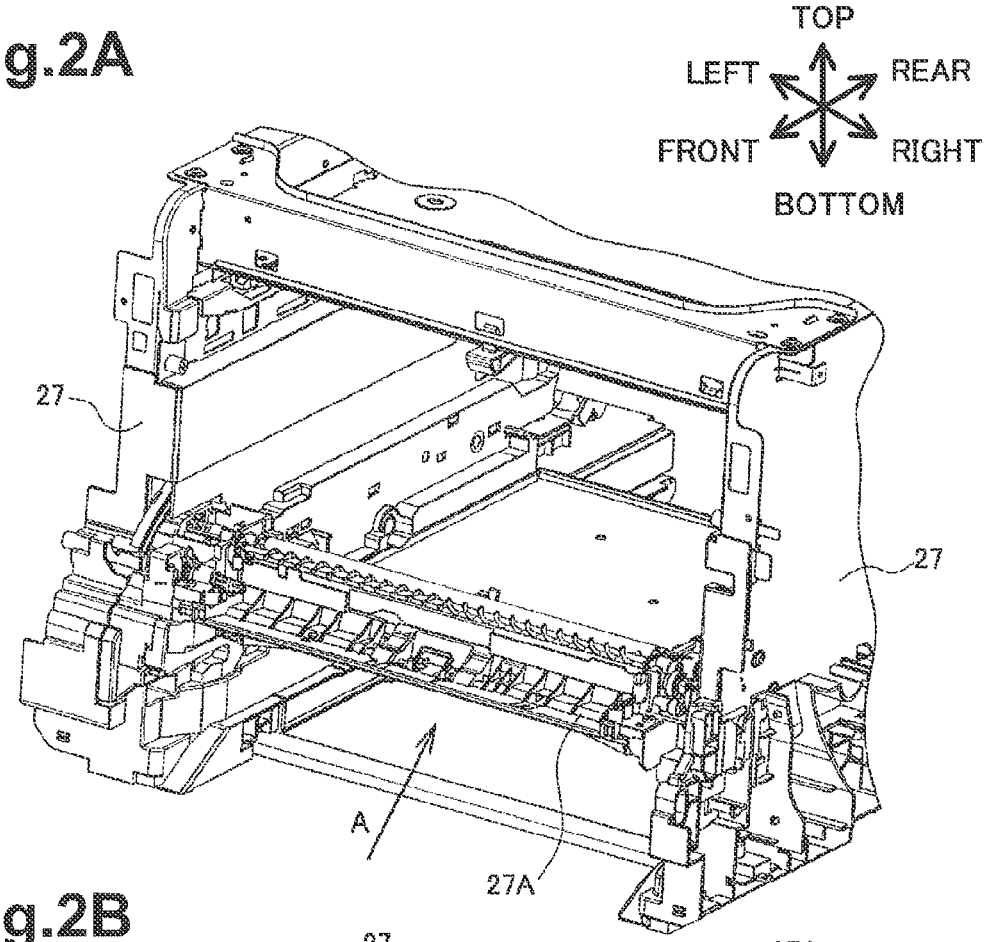
FIG. 2A is a diagram illustrating an arrangement of a main frame and a sub frame of the image forming apparatus according to the embodiment of the present invention and FIG. 2B is a diagram along an arrow A of FIG. 2A.

As illustrated in FIG. 2A, the image forming unit 5 including the process cartridge 7, the fixing unit 13 and other components is disposed between a pair of substantially plate-shaped main frames 27 and is supported directly or indirectly by the main frames 27. In FIG. 2A, the image forming unit 5, the paper cassette 15 and some other components are not illustrated.

The pair of main frames 27 are joined by a sub frame 27A extending between these main frames 27. The separation roller 19 and the conveyance roller 23 which constitute the roller unit 29 are attached to the sub frame 27A.

2. Configuration of Roller Unit and Other Components

Figure 3A:
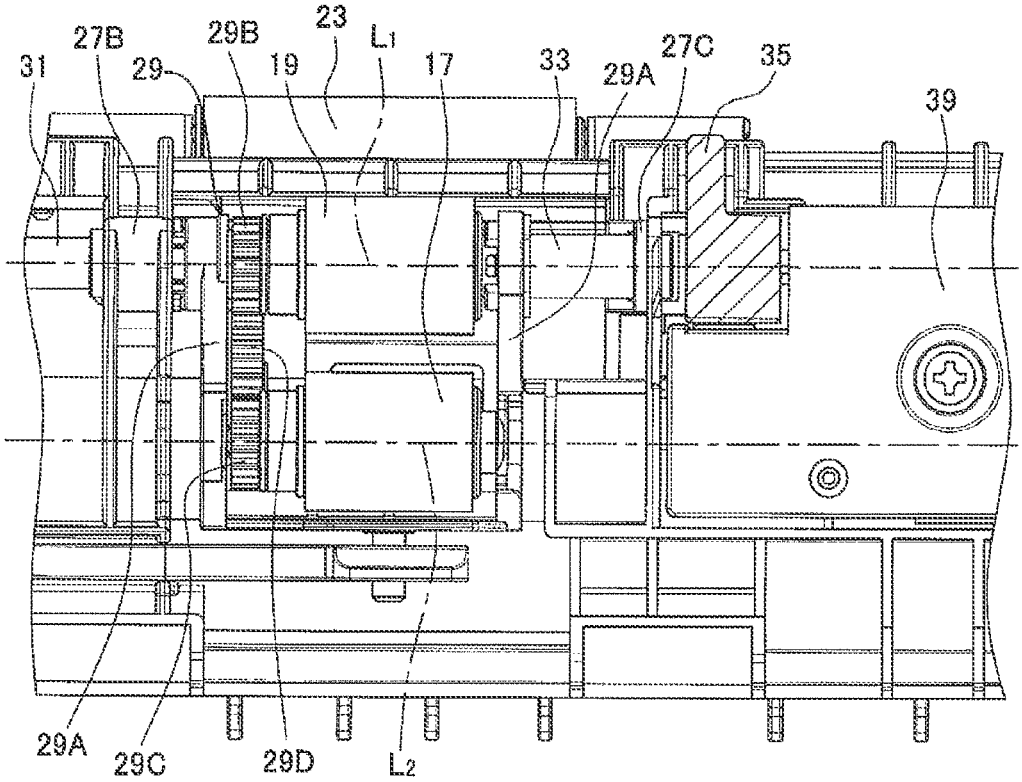
FIGS. 3A and 3B are diagrams of a roller unit of the image forming apparatus according to the embodiment of the present invention seen from below.

As illustrated in FIG. 3A, the pickup roller 17 is disposed such that an axis line L2 thereof is in parallel with an axis line L1 of the separation roller 19. A pair of roller holders 29A are provided to extend toward the pickup roller 17 from both ends of the separation roller 19 in the axial direction.

The pickup roller 17 is rotatably attached to front ends of the pair of roller holders 29A. Therefore, the pickup roller 17 and the separation roller 19 are configured to operate as a single part.

A driven gear 29C which is rotated integrally with the pickup roller 17 is provided at an axis end of the pickup roller 17. Rotating force is transmitted to the driven gear 29C from a driving gear 29B via an intermediate gear 29D which meshes with the driving gear 29B which is rotated integrally with the separation roller 19.

The roller holders 29A are rotatable about the axis line L1 of the separation roller 19 and the intermediate gear 29D is rotatably supported by the roller holders 29A. If the separation roller 19 is rotated in a state in which the pickup roller 17 is not in contact with the sheet, i.e., the roller holders 29A are rotatable, the pickup roller 17 is not rotated but turn about the separation roller 19 together with the roller holders 29A.

If the pickup roller 17 comes in contact with the sheet and rotation of the roller holders 29A is regulated, the intermediate gear 29D begins to rotate with respect to the roller holders 29A and thus the pickup roller 17 begins to rotate. In this manner, in the present embodiment, when the rotating force is transmitted to the separation roller 19, the pickup roller 17 turns and moves to a position at which the pickup roller 17 comes in contact with the sheet and then begins to rotate.

The driving shaft 31 is a transmission shaft which transmits the rotating force to the separation roller 19. The driving shaft 31 is disposed on the axis line L1 of the separation roller 19 and is removably connected to an end of the separation roller 19 in the axial direction. The driving shaft 31 is rotatably supported by a bearing portion 27B provided in the sub frame 27A.

Figure 4A:
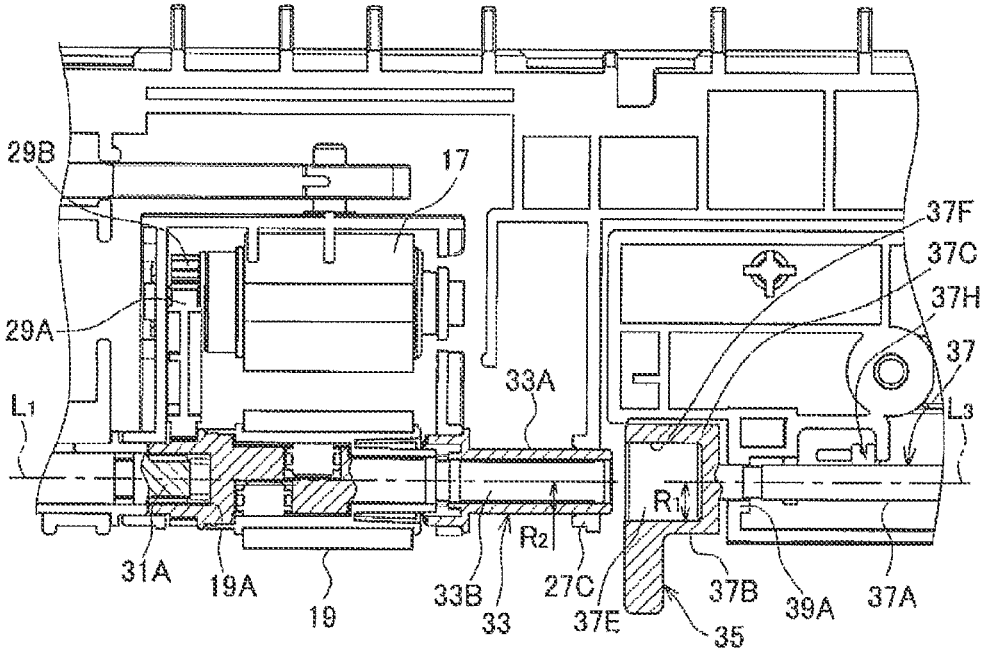
FIG. 4A is an A-A cross-sectional view of FIG. 2B illustrating a connected state and FIG. 4B is an A-A cross-sectional view of FIG. 2B illustrating a non-connected state.
Figure 4B:
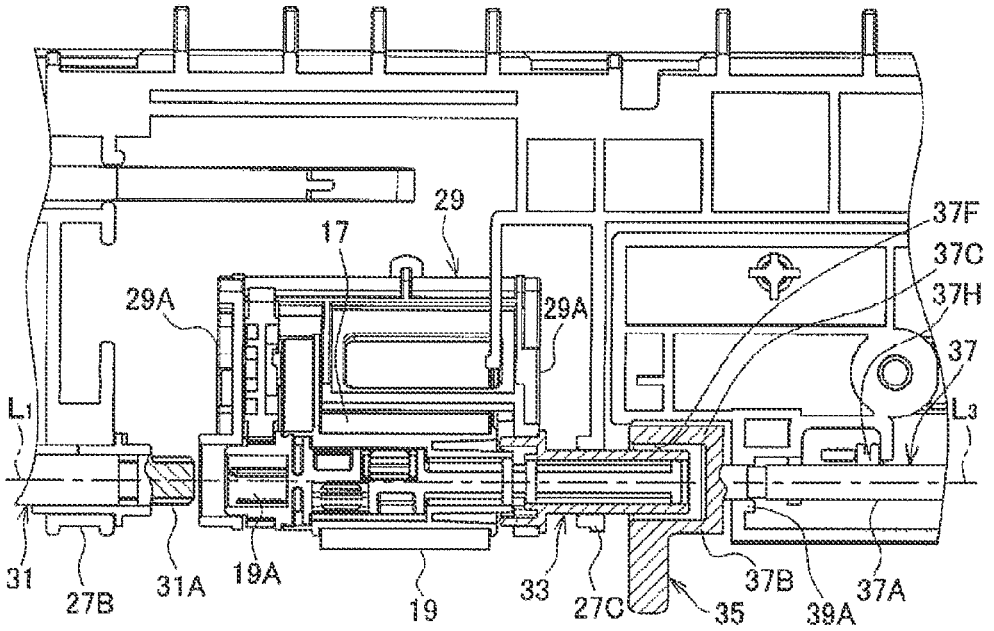

As illustrated in FIG. 4B, a spline-shaped engaging portion 31A is provided at one end of the driving shaft 31 in the longitudinal direction, that is, provided on the separation roller 19 side. The engaging portion 31A removably engages with a cylindrical engagement receiving portion 19A provided in the separation roller 19. The other end of the driving shaft 31 in the longitudinal direction extends to a main frame 27, and receives rotating force from a driving source, such as an electric motor, provided in the main frame 27.

A support shaft 33 which supports the separation roller 19 is provided at the other end of the separation roller 19 in the axial direction. The support shaft 33 extends along the axial direction in a direction away from the separation roller 19.

As illustrated in FIG. 4A, the support shaft 33 is constituted by an outer cylindrical shaft 33A and a central shaft 33B and other components. The outer cylindrical shaft 33A is fixed to the roller holders 29A. The central axis 33B is rotatably inserted in the outer cylindrical shaft 33A and is rotated integrally with the separation roller 19.

Figure 2B:
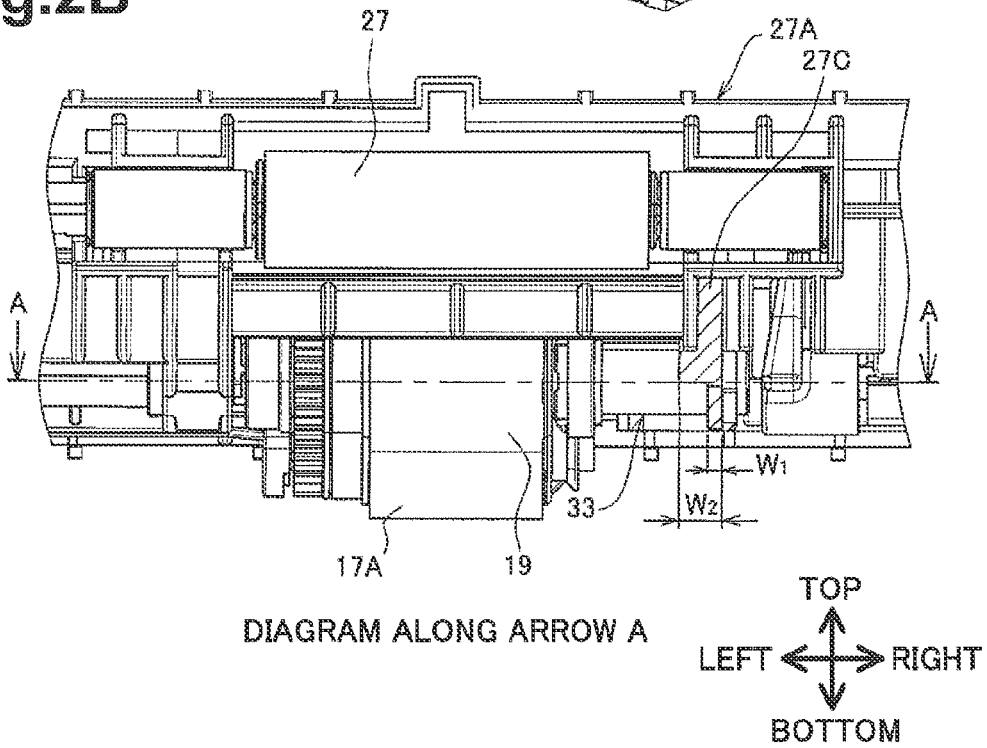

The support shaft 33, i.e., the outer cylindrical shaft 33A, is supported by a bearing portion 27C provided in the sub frame 27A so as to be able to move in parallel in the axial direction. As illustrated in FIG. 2B, in an inner peripheral surface of the bearing portion 27C, that is, a surface of the bearing portion 27C in contact with an outer peripheral surface of the outer cylindrical shaft 33A, a width dimension W1 at the paper cassette 15 side is smaller than a width dimension W2 at the sub frame 27A side.

The width dimension of the bearing portion 27C is the dimension at an area in parallel with the axial direction. In the present embodiment, the paper cassette 15 side of the bearing portion 27C corresponds to the lower side of the bearing portion 27C and the sub frame 27A side of the bearing portion 27C corresponds to the upper side of the bearing portion 27C.

Since the support shaft 33 is configured to be movable in parallel with the axial direction, the separation roller 19 may be moved in parallel with the axial direction together with the pickup roller 17 as the roller unit 29.

Therefore, as illustrated in FIG. 4A, rotating force is transmitted to the separation roller 19 from the driving shaft 31 when the roller unit 29 is positioned apart from the bearing portion 27C and the engagement receiving portion 19A of the separation roller 19 and the engaging portion 31A of the driving shaft 31 are in engagement with each other. Hereinafter, the state illustrated in FIG. 4A and FIG. 3A will be referred to as a connected state.

Figure 3B:
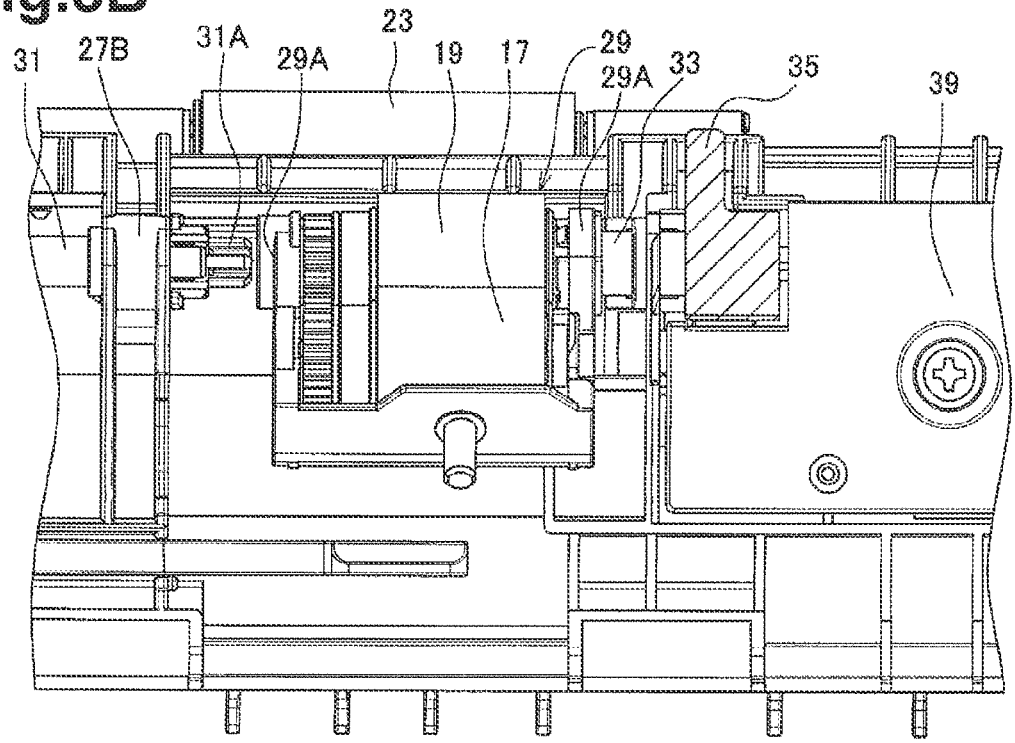

Since connection and engagement between the engagement receiving portion 19A and the engaging portion 31A are canceled when the roller unit 29 in its connected state is moved to approach the bearing portion 27C in parallel with the axial direction as illustrated in FIG. 3B, one end of the roller unit 29 in the axial direction, i.e., the driving shaft 31 side thereof is free and not supported by the sub frame 27A. Hereinafter, the state illustrated in FIG. 4B and FIG. 3B will be referred to as a non-connected state.

Figure 5A:
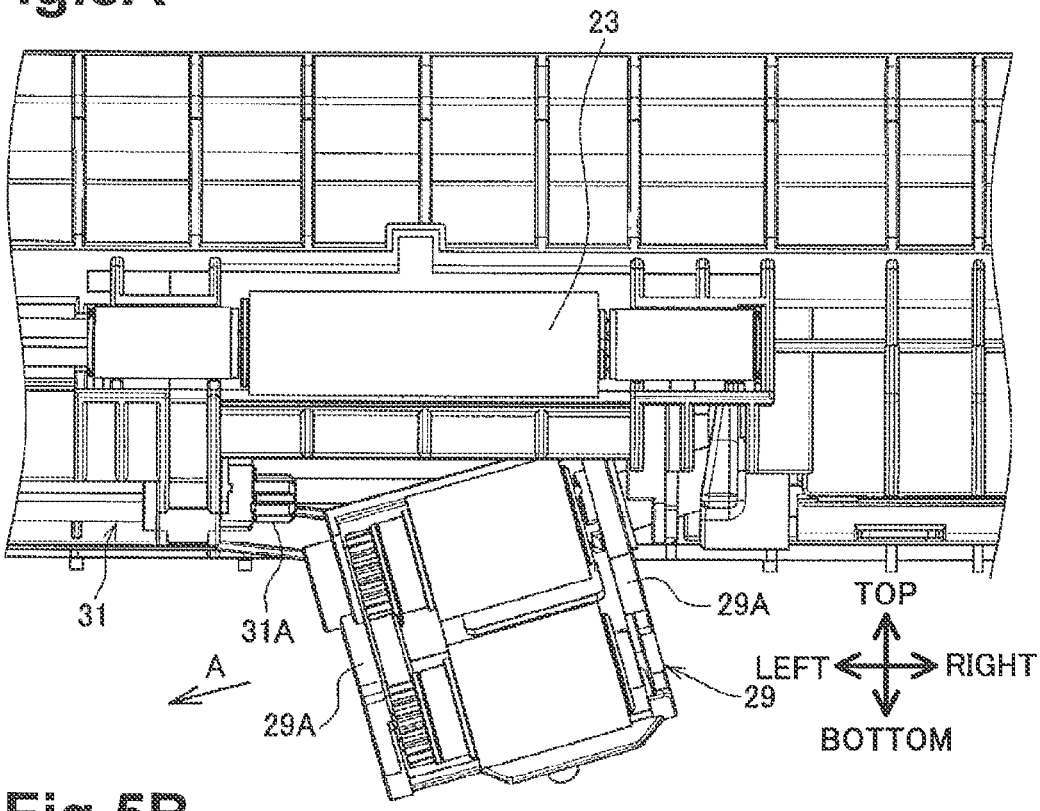
Figure 5B:
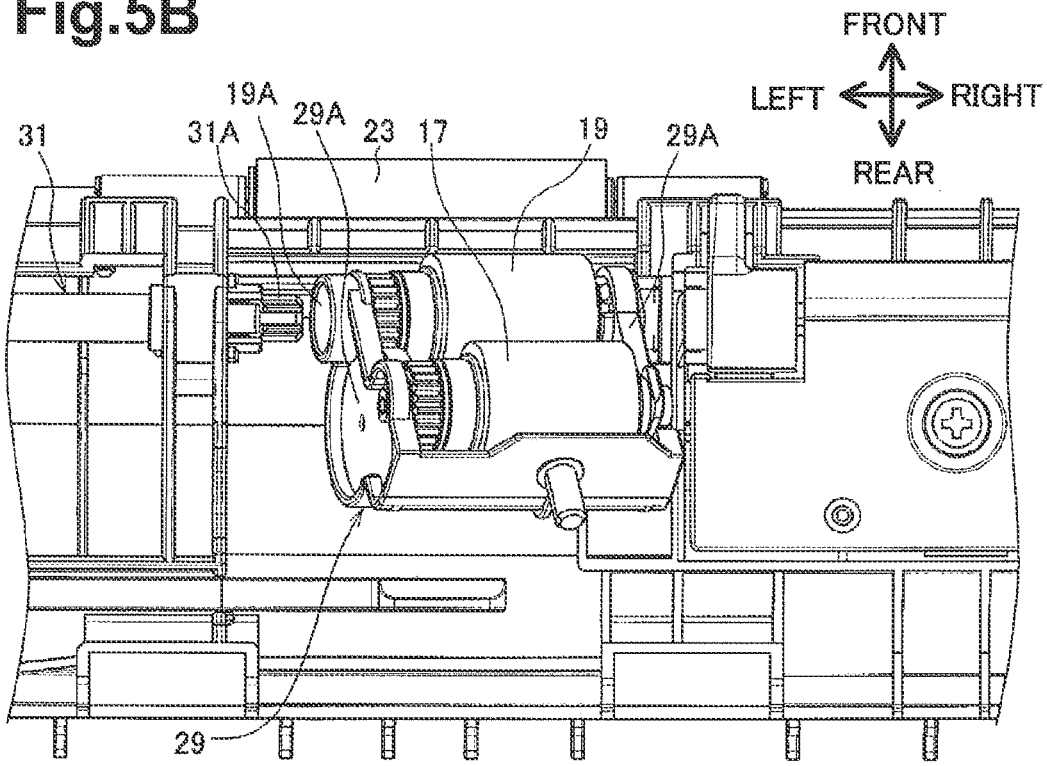

Therefore, as illustrated in FIGS. 5A and 5B, when the roller unit 29 is in its non-connected state, the support shaft 33 may be pulled out of the bearing portion 27C by causing the roller unit 29 to move toward the driving shaft 31 in a state in which the roller unit 29 is inclined such that its driving shaft 31 side is moved downward toward the paper cassette 15.

In the present embodiment, since the width dimension W1 of the bearing portion 27C at the paper cassette 15 side is smaller than the width dimension W2 at the sub frame 27A side, the roller unit 29 may easily be moved into an inclined state.

3. Trailing End of Sheet Detecting Mechanism

In the image forming apparatus 1 according to the present embodiment, rotation of the pickup roller 17 and the separation roller 19, i.e., rotation of the driving source, is controlled in accordance with the position of the sheet conveyed toward the image forming unit 5 from the roller unit 29.

Figure 6B:
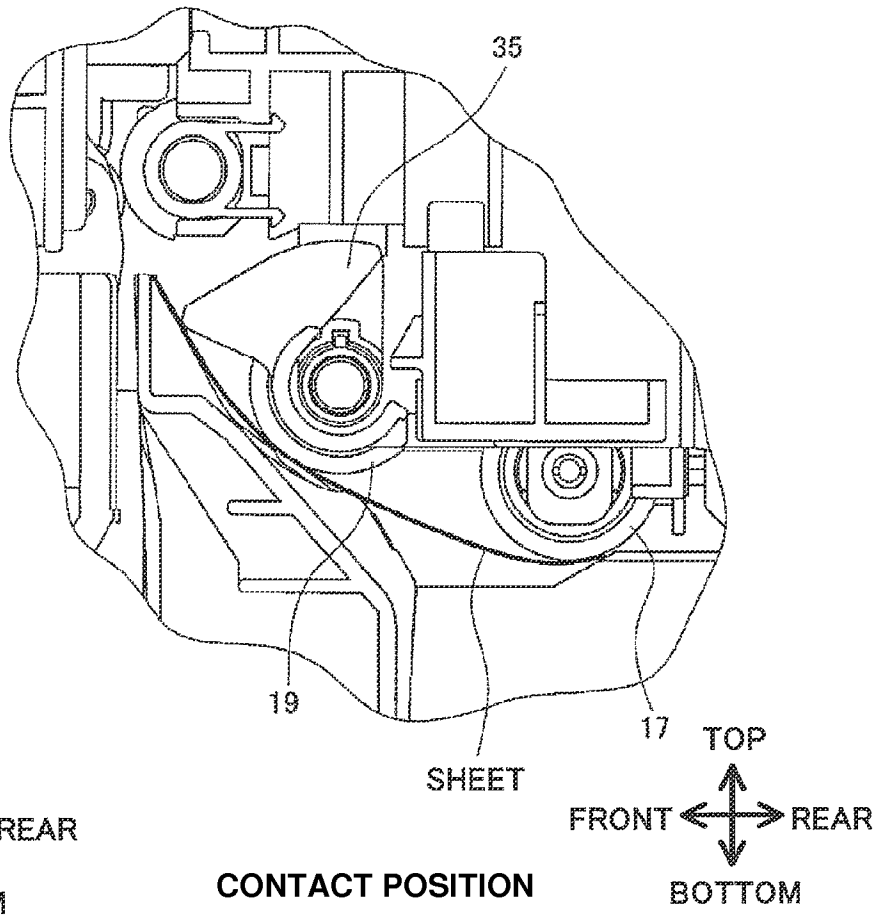
Figure 6A:
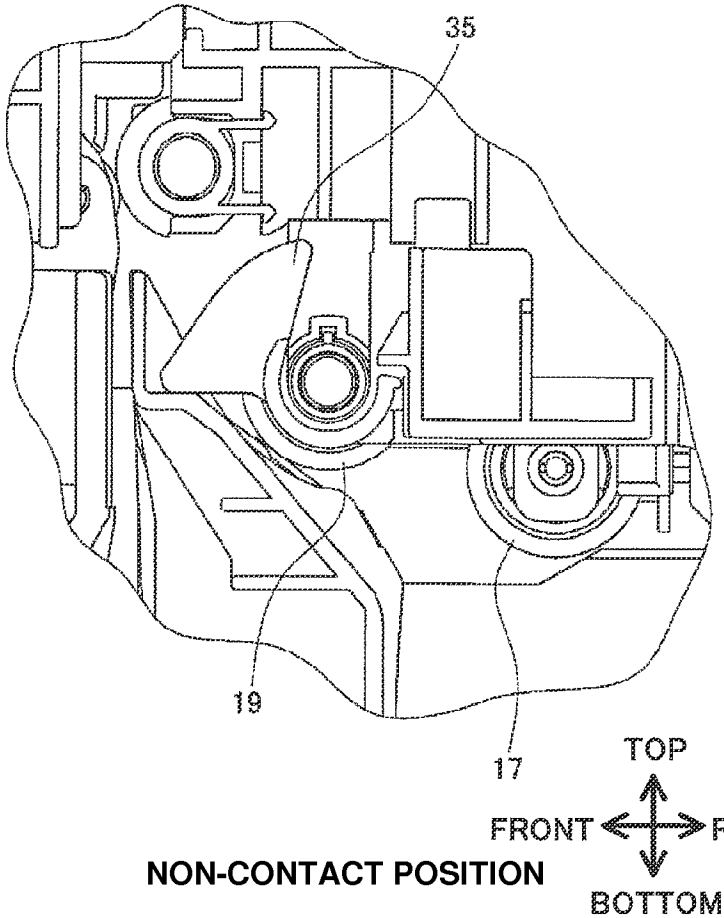

In particular, as illustrated in FIGS. 6A and 6B, a substantially fan-shaped contact member 35 which pivots between a contact position and a non-contact position is provided. In the contact position, the contact member 35 is in contact with the sheet conveyed by the separation roller 19. In the non-contact position, the contact member 35 is not in contact with the sheet. The contact member 35 is an example of an actuator and a contacting portion.

Start and stop of the driving source are controlled with reference to the time when the contact member 35 pivots to move to the non-contact position illustrated in FIG. 6A from the contact position illustrated in FIG. 6B, that is, when the trailing end in the conveying direction of the sheet conveyed by the separation roller 19 is separated from the separation roller 19.

As illustrated in FIGS. 3A and 3B, the contact member 35 is disposed at the other end of the separation roller 19 in the axial direction, i.e., at the end in the direction in which the support shaft 33 extends. A pivot point line of the contact member 35 is disposed coaxially with the axis line L1 of the separation roller 19. Thus, the contact member 35 pivots in the conveying direction so as to move forward and backward in the conveying direction.

Figure 7A:
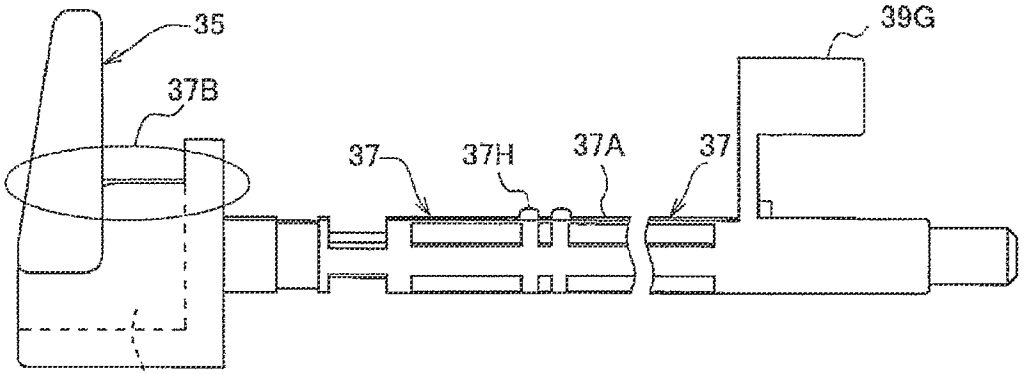
FIGS. 7A to 7C are diagrams illustrating a pivot shaft of the image forming apparatus according to the embodiment of the present invention seen from three directions.

As illustrated in FIG. 7A, a pivot shaft 37 which supports the contact member 35 to be pivotable is a crankshaft-shaped shaft having a rotating shaft 37A, an eccentric portion 37B, and other components. The pivot shaft 37 is an example of an actuator.

Figure 8:
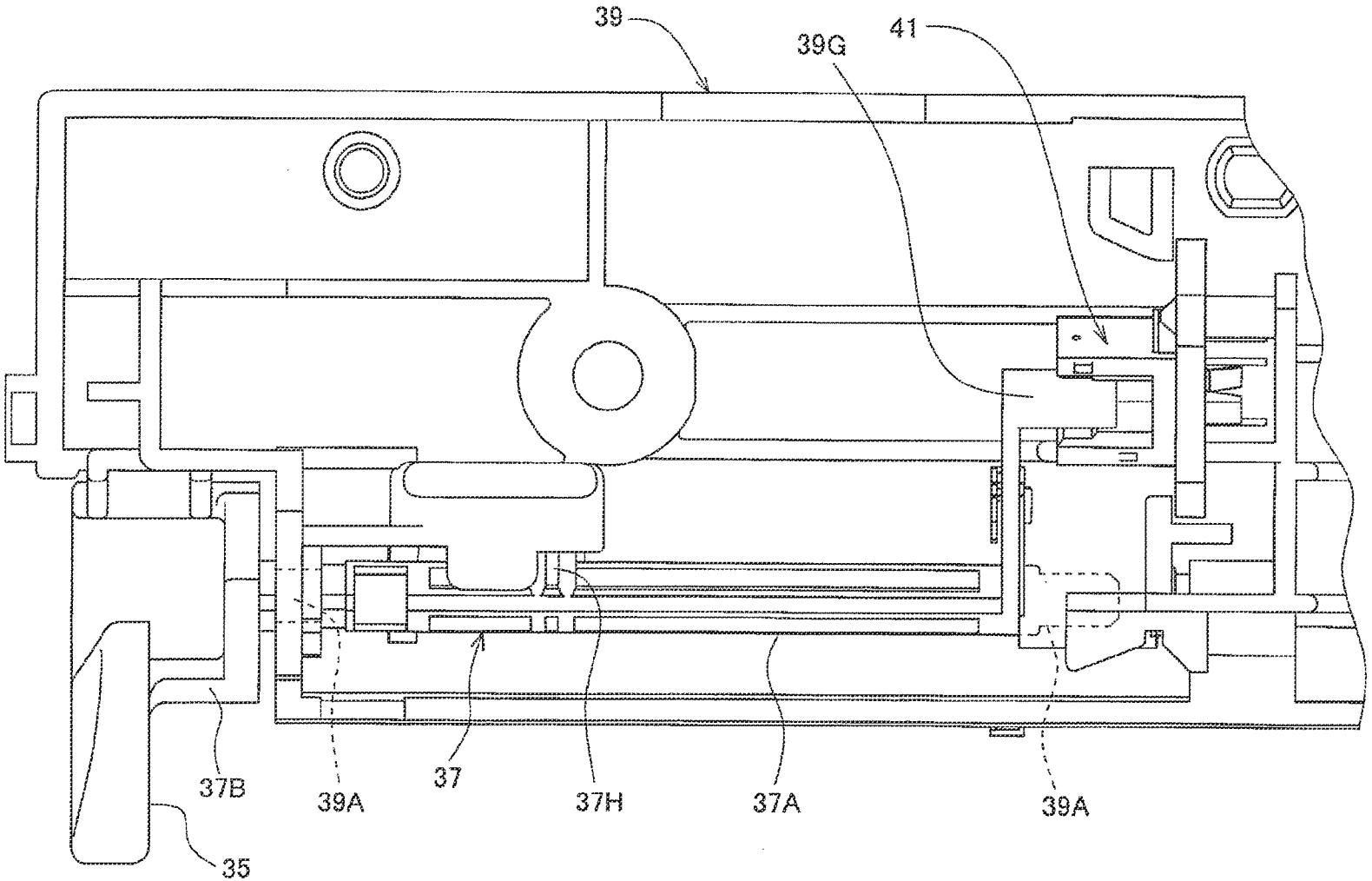
FIG. 8 is a diagram illustrating a state in which the pivot shaft of the image forming apparatus according to the embodiment of the present invention is attached to an actuator holder.

As illustrated in FIGS. 4A and 4B, the rotating shaft 37A is a linear shaft of which an axis line L3 is disposed coaxially with the axis line L1 of the separation roller 19. Both ends of the rotating shaft 37A in the axial direction are rotatably supported by a pair of bearing portions 39A provided in an actuator holder 39 as illustrated in FIG. 8.

The actuator holder 39 is removably attached to the sub frame 27A from the paper cassette 15 side, i.e., from below, as illustrated in FIGS. 3A and 3B. The actuator holder 39 according to the present embodiment is fixed to the sub frame 27A by, for example, a mechanical fastening means using screws or other parts, or an engaging portion with elastic deformation.

The eccentric portion 37B is provided at an end of the rotating shaft 37A on the separation roller 19 side in the axial direction as illustrated in FIGS. 4A and 4B. That is, the eccentric portion 37B is positioned at the other end side of the separation roller 19 in the axial direction with respect to the roller unit 29. The eccentric portion 37B extends toward the separation roller 19 at a position eccentric to the axis line L3 of the rotating shaft 37A.

Figure 7B:
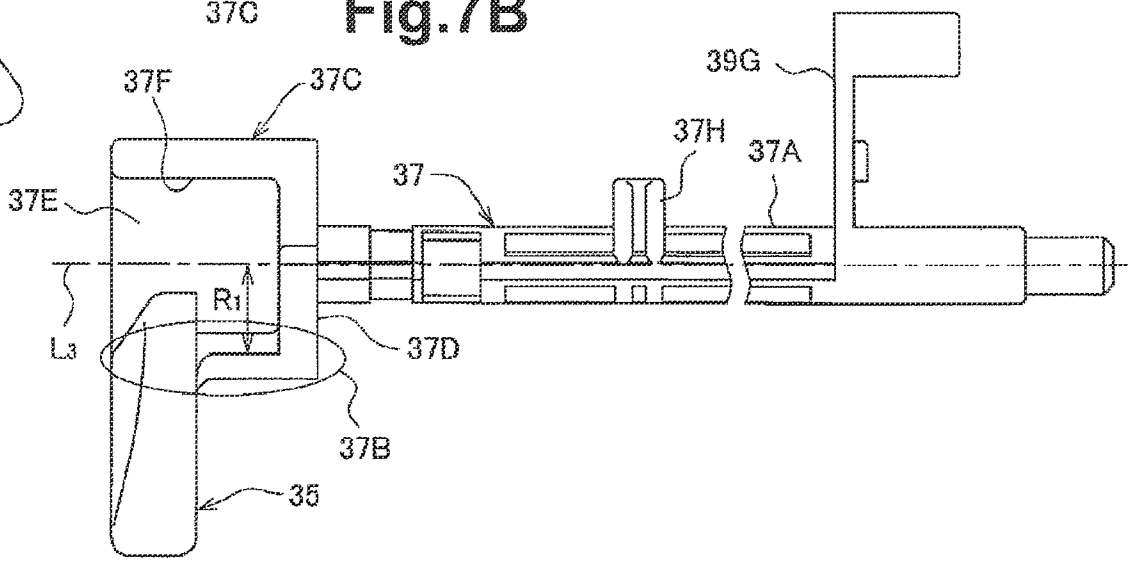

The eccentric portion 37B according to the present embodiment is formed as a part of a cup-shaped pocket portion 37C which opens on the separation roller 19 side. That is, as illustrated in FIG. 7B, the pocket portion 37C is constituted by a substantially disc-shaped flange 37D, a cylindrical portion 37E, and other components. The flange 37D extends in the radial direction from the end of the rotating shaft 37A in the axial direction. The cylindrical portion 37E extends toward the separation roller 19 from the flange 37D.

Since the eccentric portion 37B is formed as a part of the cylindrical portion 37E, the pocket portion 37C is provided in the eccentric portion 37B. Since the pocket portion 37C is formed as a cup opening on the separation roller 19 side, the support shaft 33 may be received by a recess 37F which is a space formed in the pocket portion 37C when the separation roller 19 is in its non-connected state as illustrated in FIG. 4B. The recess 37F is an example of a receiving portion.

Therefore, the internal radius of the cylindrical portion 37E, i.e., the distance R1 from the axis line L3 of the rotating shaft 37A to the eccentric portion 37B, is set to be larger than the outer radius R2 of the support shaft 33 as illustrated in FIG. 4A. The contact member 35 is provided in the eccentric portion 37B, i.e., at the end of the cylindrical portion 37E on the separation roller 19 side, as illustrated in FIG. 7B.

Figure 7C:
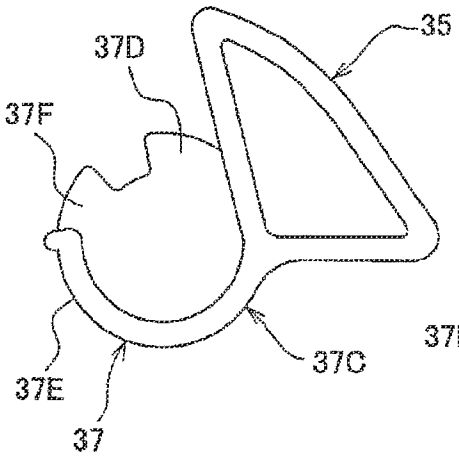

As illustrated in FIG. 7C, the cylindrical portion 37E of the pocket portion 37C is formed as a gutter in which a part of a cylindrical wall is opened. Therefore, when the roller unit 29 is in its non-connected state, as illustrated in FIG. 5A, the roller unit 29 may be inclined to be moved toward the paper cassette 15.

As illustrated in FIG. 8, a blocking portion 39G is provided at the end of the rotating shaft 37A in an axial direction opposite to the eccentric portion 37B side. The blocking portion 39G blocks an optical path from a light emitting unit to a light receiving unit of an optical sensor 41 by pivoting integrally with the rotating shaft 37A. The optical sensor 41 is an existing sensor having the light emitting unit and the light receiving unit, and outputs signals depending on whether the light receiving unit has received the light emitted from the light emitting unit. The blocking portion 39G is an example of a detected portion.

In the present embodiment, the rotating shaft 37A, the pocket portion 37C including the eccentric portion 37B, and the blocking portion 39G, and the contact member 35 are integrally made of resin to form a single member.

A projecting portion 37H which projects in a radial direction is provided at an intermediate portion of the rotating shaft 37A in the axial direction. In the present embodiment, as illustrated in FIGS. 4A and 4B, displacement of the pivot shaft 37 with respect to the actuator holder 39 in the axial direction is restricted by causing the projecting portion 37H to be in sliding contact with the actuator holder 39.

4. Characteristic of Image Forming Apparatus (Particularly Trailing End Detecting Mechanism) According to the Present Embodiment In the present embodiment, since the contact member 35 is eccentric to the axis line L3 of the rotating shaft 37A, even if the separation roller 19, i.e., the roller unit 29, is moved in the axial direction, the roller unit 29 and the contact member 35 do not interfere with each other. Therefore, the contact member 35 may be moved to approach the center of the separation roller 19 in the axial direction in a state in which the contact member 35 is situated on the axis line L1 of the separation roller 19.

In a case in which the eccentric portion 37B is not provided and the contact member 35 is provided in the rotating shaft 37A, it is necessary to dispose the contact member 35 at a position spaced apart from the roller unit 29 by a distance greater than the dimension required for removal. The dimension required for removal herein represents distance in the axial direction required for the removal of the roller unit 29.

For this reason, in a case in which the contact member 35 is not eccentric and the contact member 35 is provided in the rotating shaft 37A, it is difficult to dispose the contact member 35 at a position close to the roller unit 29, i.e., the separation roller 19.

In the present embodiment, the contact member 35 is provided in the eccentric portion 37B, that is, at the end of the cylindrical portion 37E on the separation roller 19 side: therefore, the contact member 35 may further be close to the center of the separation roller 19 in the axial direction.

In the present embodiment, the pocket portion 37C having the recess 37F that may receive the support shaft 33 is provided in the eccentric portion 37B: therefore, rigidity of the pivot shaft 37 is high compared with a case in which the pivot shaft 37 is formed by simply bending a rod material into a crankshaft shape.

In the present embodiment, the pocket portion 37C is formed as a cylinder of which a part of the cylindrical wall is opened: therefore, as described above, the support shaft 33 may be removed easily from the opened position.

Other Embodiments

Although the present invention is applied to the roller unit 29, i.e., to the separation roller 19 and the trailing end detecting mechanism in the embodiment described above, application of the present invention is not limited to the same: for example, the present invention may be applied also to other rollers and a leading end detecting mechanism.

Although the eccentric portion 37B is formed as a part of the pocket portion 37C in the embodiment described above, the present invention is not limited to the same: for example, the pocket portion 37C is not formed and a rod material may be simply bent as a crankshaft to form the pivot shaft 37.

Although the present invention is applied to a monochrome laser printer in the embodiment described above, the present invention is not limited to the same: the present invention may be applied also to, for example, a color laser printer and an inkjet image forming apparatus.

It is only necessary that the present invention is in the scope of the invention described in the claims: thus, the present invention is not limited to the embodiments described above.

What is claimed is:

1. An image forming apparatus, comprising:

an image forming unit configured to form an image on a sheet;

a roller configured to rotate in contact with the sheet;

a driving shaft disposed coaxially with an axis of the roller and configured to transmit a rotating force to the roller and to be removably connected to a first end of the roller in an axial direction;

a support shaft disposed at a second end of the roller in the axial direction, configured to support the roller, and extending in the axial direction;

a bearing portion configured to support the support shaft such that the support shaft is movable in the axial direction;

a contact member disposed at a side of the roller in the axial direction which includes the second end and configured to pivot between a contact position in which the contact member is in contact with the sheet conveyed by the roller and a non-contact position in which the contact member is not in contact with the sheet; and a pivot shaft configured to pivotably support the contact member and comprising:

a rotating shaft disposed coaxially with the axis of the roller; and an eccentric portion extending toward the side of the roller in the axial direction which includes the second end, wherein the eccentric portion is eccentric with respect to an axis of the rotating shaft, wherein:

the contact member is disposed in the eccentric portion; and a distance from the axis of the rotating shaft to the eccentric portion in a radial direction is larger than a dimension of the support shaft extending from the axis of the roller to an outer surface of the support shaft in the radial direction.

2. The image forming apparatus according to claim 1, wherein the contact member is disposed in the eccentric portion at an end of the pivot shaft which is nearest to the side of the roller in the axial direction which includes the second end.

3. The image forming apparatus according to claim 1, further comprising a pocket portion disposed in the eccentric portion and including a concave portion capable of receiving the support shaft.

4. The image forming apparatus according to claim 3, wherein the pocket portion is formed as a cylinder in which a part of a cylindrical wall of the cylinder is opened.

5. The image forming apparatus according to claim 3, wherein the pocket portion, the eccentric portion, and the rotating shaft are integrally formed of resin.

6. The image forming apparatus according to claim 1, further comprising a holder, wherein:

the bearing portion is disposed in a frame extending in a direction parallel to the axial direction; and the holder is configured to support the rotating shaft and is removably attached to the frame.

7. The image forming apparatus according to claim 1, wherein, when the roller and the support shaft move toward the contact member, the driving shaft and the first end of the roller in the axial direction are disconnected from each other before the support shaft comes in contact with the pivot shaft.

8. The image forming apparatus according to claim 1, further comprising a separating pad configured to apply conveyance resistance to the sheet and disposed at a position facing the roller.

* * * * *